United States Patent [19]

Barrett et al.

[11] Patent Number: 4,780,276

[45] Date of Patent: Oct. 25, 1988

[54] CASTABLE HOT CORROSION RESISTANT ALLOY

[75] Inventors: Charles A. Barrett, Fairview Park; William H. Holt, Elyria, both of Ohio

[73] Assignee: The Unites States of America as represented by the Administrator of the National Aeronautics and Space Administration, Washington, D.C.

[21] Appl. No.: 108,331

[22] Filed: Oct. 14, 1987

Related U.S. Application Data

[63] Continuation-in-part of Ser. No. 890,584, Jul. 30, 1986.

[51] Int. Cl.[4] ..... C22C 38/50

[52] U.S. Cl. ..... 420/54; 420/62; 420/79; 420/80; 420/81

[58] Field of Search ..... 148/327; 420/43, 54, 420/62, 79, 80, 81, 584, 586

[56] References Cited

U.S. PATENT DOCUMENTS

| | | | |
|---|---|---|---|
| 2,063,513 | 7/1935 | Lohr | 420/43 |
| 2,570,193 | 10/1951 | Bieber et al. | 420/584 |
| 3,203,791 | 8/1965 | Franklin et al. | 420/584 |
| 3,817,747 | 6/1974 | Schultz et al. | 420/445 |
| 4,054,469 | 10/1977 | Jackson | 420/445 |
| 4,086,085 | 4/1978 | McGurty | 420/584 |
| 4,110,110 | 8/1978 | Kondo et al. | 420/452 |
| 4,340,425 | 7/1982 | Barrett et al. | 420/445 |
| 4,535,034 | 8/1985 | Zaizen et al. | 420/43 |

*Primary Examiner*—Deborah Yee

*Attorney, Agent, or Firm*—Gene E. Shook; John R. Manning

[57] ABSTRACT

About ten weight percent nickel is added to a Fe-base alloy which has a ferrite microstructure to improve the high temperature castability and crack resistance while about 0.2 weight percent zirconium is added for improved high temperature cyclic oxidation and corrosion resistance. The basic material is a high temperature FeCrAl heater alloy, and the addition provides a material suitable for burner rig nozzles.

8 Claims, 2 Drawing Sheets

TIME, HRS

CASTABLE HOT CORROSION RESISTANT ALLOY

ORIGIN OF THE INVENTION

The invention described herein was made by employees of the United States Government and may be manufactured and used by or for the Government for governmental purposes without the payment of any royalties thereon or therefor.

STATEMENT OF COPENDENCY

This application is a continuation-in-part of copending application Ser. No. 890,584 which was filed on July 30, 1986.

TECHNICAL FIELD

This invention is concerned with an improved high temperature oxidation/hot corrosion resistant alloy that is castable. The improved alloy is particularly useful in burner rig nozzles when extended life is required.

No satisfactory alloy is available for preventing hot corrosion in nozzles. Prior art alloys fail by service cracking after a few hours use. Nozzles made of these alloys have to be replaced because of excessive erosion in the nozzle throat after a few hundred hours use.

A cobalt alloy is used in high temperature oxidation testing. This alloy also has uses in hot corrosion testing, but it does not have an adequate lifetime.

Other alloys have been suggested for hot corrosion protection. However, such alloys have limited life. Also, many of the prior art alloys are cobalt based and are very expensive.

It is, therefore, an object of the present invention to provide an improved Fe-base ferritic alloy for achieving high temperature oxidation/hot corrosion resistance in burner rig nozzles.

BACKGROUND ART

U.S. Pat. No. 2,063,513 to Lohr discloses a Fe base ferritic alloy for use in heaters. This alloy contains, among other things, 0.01%–1.0% Al and 20%–50% Ni. This alloy has not only a high nickel content but also a low aluminum content.

DISCLOSURE OF INVENTION

The present invention is concerned with an improved Fe-base ferritic alloy. The nominal composition of this alloy is 20% chromium, 5% aluminum, 10% nickel, 0.2% zirconium, 0.1% carbon, 0.4% silicon and the balance iron.

This composition is normally held to ±10% of the nominal composition. However, the chromium can vary from 20% to 25%. That this alloy provides high temperature oxidation/hot corrosion resistance in burner rig nozzles is evidenced by the fact that some of the nozzles are still operational at least 1000 hours.

BRIEF DESCRIPTION OF THE DRAWING

The objects, advantages, and novel features of the invention will be more fully apparent from the following detaiied description when read in connection with the accompanying drawings in which.

BEST MODE FOR CARRYING OUT THE INVENTION

The basic material of the present invention is a high temperature FeCrAl heater alloy. While such an alloy has a potential for use in burner rigs, it tends to crack in service and erode excessively.

The castability of this basic alloy is improved considerably by adding 10% by weight nickel. This nickel addition minimizes the tendency of the base alloy to crack upon exposure to high temperatures in service.

The cyclic oxidation/corrosion resistance of the alloy is improved by adding 0.2 w/o Zr. The chromium and aluminum contents of the alloys are adjusted to accommodate the nickel and zirconium additions.

For optimum results the basic composition is held to ±10% of the aforementioned nominal composition. More particularly, the composition of the Fe-base alloy of the invention which has a ferrite microstructure is about 20 w/o chromium, about 4.5 w/o to about 5.5 w/o aluminum, about 9 w/o to about 11 w/o nickel, about 0.18 w/o to about 0.22 w/o zirconium, about 0.09 w/o to about 0.11 w/o carbon, about 0.36 w/o to about 0.44 w/o silicon and the remainder being iron. However, the chromium content may vary from 20 w/o to 25 w/o.

From testing the alloy it is found that the addition of nickel improves its castability and resistance to thermal shock. The zirconium addition improves protective scale adhesion during cyclic exposure.

Figure 1:
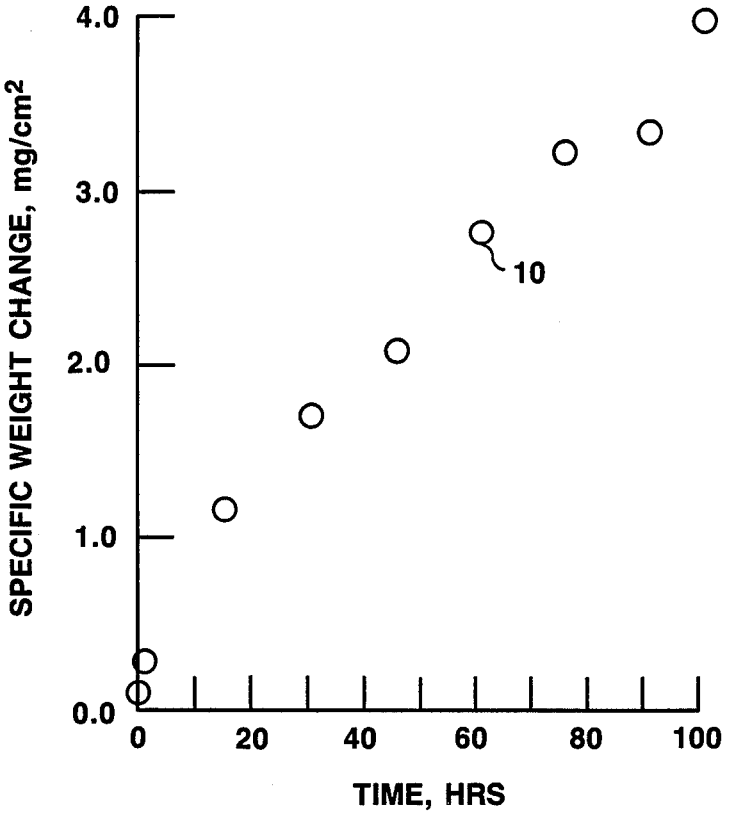
FIG. 1 is a cyclic oxidation curve which shows specific weight change plotted against time for 1000 cycles at 0.10 hour per cycle for a total of 100 exposure hours at 1200° C. in static air of 1.964 mm thick test samples of alloys made in accordance with the present invention.

Referring now to the drawings there is shown in FIG. 1 a cyclic oxidation curve defined by the points 10 for a Fe Cr Al ferritic heater type alloy made in accordance with the present invention and containing about 10 w/o Ni and about 0.2 w/o Zr. The curve is nearly parabolic with no significant weight loss and exhibits a very low scaling rate. The test samples showed virtually no spalling. The only oxides observed were the protective $Al_2O_3$ and aluminate spinel. This is indicative of the long time oxidative resistance of this alloy at temperatures below 1200° C.

The same alloy was tested at 1200° C. with one hour cycles. The cyclic oxidation curve is defined by the points 12 in FIG. 2.

Figure 2:
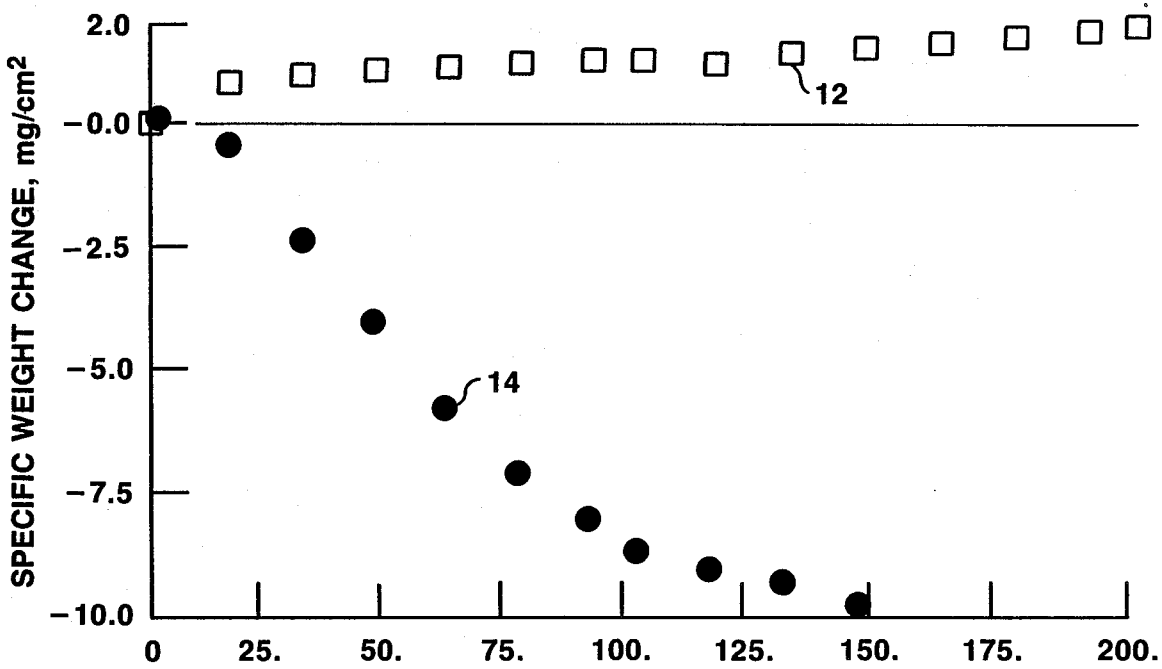
FIG. 2 shows two cyclic oxidation curves similiar to FIG. 1 for two alloys, one containing 0.2 weight percent zirconium and the other containing no zirconium, which were similiarly tested at 1200° C. at one hour cycles.

A similiar alloy was prepared without any zirconium being added. This alloy was also tested at 1200° C. with one hour cycles. The resulting cyclic oxidation curve defined by the points 14 in FIG. 2 shows a drastic linear weight loss indicating much poorer cyclic oxidation resistance.

While the preferred composition of the alloy has been described, it will be appreciated various composition changes and modifications may be made without departing from the spirit of the inventions or the scope of the subjoined claims.

We claim:

1. An improved high temperature Fe-base alloy which has a ferrite microstructure and consists essentially of about 20 w/o to about 25 w/o chromium, about 4.5 w/o to about 5.5 w/o aluminum, about 9 w/o to about 11 w/o nickel, about 0.18 to about 0.22 w/o zirconium, about 0.09 w/o to about 0.11 w/o carbon, about 0.36 w/o to about 0.44 w/o silicon, and the remainder being iron.

2. An alloy as claimed in claim 1 wherein the nickel content is about 10 weight percent for improved high temperature castability and crack resistance.

3. An alloy as claimed in claim 1 wherein the zirconium content is about 0.2 weight percent for improved high temperature cyclic oxidation and corrosion resistance.

4. In a Fe-base alloy which has a ferrite microstructure and contains about 20 w/o to about 25 w/o chromium and about 4.5 w/o to about 5.5 w/o aluminum, the improvement comprising the addition of about 9 w/o to about 11 w/o nickel to improve castability and minimize cracking at high temperatures, about 0.18 w/o to about 0.22 w/o zirconium to improve cyclic oxidation and corrosion resistance at high temperatures and the remainder being iron.

5. A Fe-base alloy as claimed in claim 4 including about 10 w/o nickel and about 0.2 w/o zirconium, and the remainder being iron.

6. A FeCrAl alloy as claimed in claim 4 having a nominal composition of about 20 w/o chromium, about 5 w/o aluminum, about 10 w/o nickel, about 0.2 w/o zirconium, and the remainder being iron.

7. A FeCrAl alloy as claimed in claim 4 including about 0.1 w/o carbon and about 0.4 w/o silicon, and the remainder being iron.

8. In a method of improving the high temperature characteristics of a FeCrAl alloy which has a ferrite microstructure, the improvement comprising adding about 10 w/o nickel to said alloy thereby improving the high temperature castability and service crack resistance, and adding about 0.2 w/o zirconium to improve high temperature cyclic oxidation and corrosion resistance.

* * * * *